US010544963B2

(12) United States Patent
Shah et al.

(10) Patent No.: US 10,544,963 B2
(45) Date of Patent: Jan. 28, 2020

(54) FIELD CONFIGURABLE LOW WATER CUT-OFFS

(71) Applicants: Pratik N. Shah, Des Plaines, IL (US); Ronan Stephens, Chicago, IL (US); James J. Gu, Buffalo Grove, IL (US); Glen E. Huse, Green Oaks, IL (US); Jaroslaw Berezowski, Mount Prospect, IL (US)

(72) Inventors: Pratik N. Shah, Des Plaines, IL (US); Ronan Stephens, Chicago, IL (US); James J. Gu, Buffalo Grove, IL (US); Glen E. Huse, Green Oaks, IL (US); Jaroslaw Berezowski, Mount Prospect, IL (US)

(73) Assignee: Fluid Handling LLC, Morton Grove, IL (US)

( * ) Notice: Subject to any disclaimer, the term of this patent is extended or adjusted under 35 U.S.C. 154(b) by 291 days.

(21) Appl. No.: 15/619,904

(22) Filed: Jun. 12, 2017

(65) Prior Publication Data

US 2018/0038615 A1 Feb. 8, 2018

Related U.S. Application Data

(60) Provisional application No. 62/348,271, filed on Jun. 10, 2016.

(51) Int. Cl.
*H05B 1/02* (2006.01)
*F24H 9/20* (2006.01)
(Continued)

(52) U.S. Cl.
CPC ..... *F24H 9/2021* (2013.01); *F24H 1/201* (2013.01)

(58) Field of Classification Search
CPC ..... F24H 9/2021; F24H 1/201; F24H 9/2035; H05B 1/0283; H05B 3/0053
(Continued)

(56) References Cited

U.S. PATENT DOCUMENTS 2,274,939 A 3/1942 Ray
3,831,429 A 8/1974 Kmiecik
(Continued)

FOREIGN PATENT DOCUMENTS

AU 1178483 A 9/1983
CA 2286167 A1 10/1998
(Continued)

OTHER PUBLICATIONS

Shome, Anabik, and S. Denis Ashok. "Fuzzy Logic Approach for Boiler Temperature & Water Level Control." International Journal of Scientific and Engineering Research 3.6 (Jun. 2012). (pp. 1-6) http://www.ijser.org/researchpaper/fuzzy-logic-approach-for-boiler-temperature-water-level-control.pdf.
(Continued)

*Primary Examiner* — Mark H Paschall
(74) *Attorney, Agent, or Firm* — Ware, Fressola, Maguire & Barber LLP

(57) ABSTRACT

A low water cutoff switch controller features a dual inline package (DIP) in combination with low water cutoff switch processor. The dual inline package (DIP) has DIP switches, each DIP switch configured to set in a respective application type or mode corresponding to a particular water heater model for the low water cutoff switch controller to control, and also configured to provide DIP switch signaling containing information about a respective DIP switch set. The low water cutoff switch processor is configured to respond to the DIP switch signaling, and also configured to respond to corresponding signaling containing information about a
(Continued)

sensed water level contained in the particular water heater model being controlled by the low water cutoff switch controller, and provide control signaling containing information to control the operation of the particular water heater model. The low water cutoff switch controller is a single controller that can be used for controlling any one of a plurality of different water heater models and have different voltage applications by setting a respective one of the DIP switches.

12 Claims, 1 Drawing Sheet

(51) Int. Cl.
*F24H 1/20* (2006.01)
*F24H 9/00* (2006.01)

(58) Field of Classification Search
USPC ..... 219/518, 494, 497, 506; 392/401, 441, 392/451
See application file for complete search history.

(56) References Cited

U.S. PATENT DOCUMENTS 3,834,357 A 9/1974 Kaczmarek et al.
4,381,075 A 4/1983 Cargill et al.
5,240,022 A 8/1993 Franklin
5,739,504 A 4/1998 Lyons et al.
5,861,683 A 1/1999 Engel et al.
6,728,600 B1 * 4/2004 Contaldo ..... F23N 1/002 236/20 R
6,757,589 B1 6/2004 Parker et al.
6,926,028 B2 8/2005 Murray et al.
7,093,611 B2 8/2006 Murray et al.
7,243,540 B2 7/2007 Merwin
7,891,572 B1 2/2011 Murray
7,966,099 B2 6/2011 Fima
7,992,527 B2 8/2011 Merwin
8,746,275 B2 6/2014 Santinanavat et al.
9,173,255 B2 10/2015 McGaugh
2001/0009609 A1 * 7/2001 Bradenbaugh ..... F24H 9/2021 392/463
2004/0177817 A1 * 9/2004 Bradenbaugh ..... F24H 9/2021 122/13.01
2015/0041700 A1 2/2015 Karia et al.

FOREIGN PATENT DOCUMENTS

CA 1196406 A 11/1998
CA 2255997 C 6/1999
CA 2488970 C 6/2005
DE 2651753 A1 5/1977

OTHER PUBLICATIONS

"Micro Genus II: Installations & service instructions Type C boilers." Ariston, Edition 2, Jan. 29, 2004. http://letsfixit.co.uk/wp-content/uploads/microGENUS-II-31-MFFI.pdf.
Kandil, Mohamed. "Computer control and monitoring of psychrometric conditions." Thesis, Univ. of Canterbury, New Zealand, Mar. 2000. http://ir.canterbury.ac.nz/xmlui/bitstream/handle/10092/6618/Kandil_Thesis.pdf.
King, Robert J. "M/S OWFN 04D03." River Bend Station—Unit I, Entergy Operations, Inc., Dec. 1999. http://citeseerx.ist.psu.edu/viewdoc/download?doi=10.1.1.417.3057&rep=rep1&type=pdf.
English language abstract of DE2651753.

* cited by examiner

| SR. NO | 120V APPLICATION | 24V APPLICATION |
|---|---|---|
| 1 | HOT WATER - AUTOMATIC MODE | HOT WATER - AUTOMATIC MODE |
| 2 | HOT WATER - MANUAL MODE | HOT WATER - MANUAL MODE |
| 3 | STEAM - AUTOMATIC MODE | STEAM - AUTOMATIC MODE |
| 4 | STEAM - MANUAL MODE | STEAM - MANUAL MODE |
| 5 | STEAM - HIGH WATER MANUAL MODE | STEAM - HIGH WATER MANUAL MODE |

Figure 2: Field Configurable LWCO

FIELD CONFIGURABLE LOW WATER CUT-OFFS

CROSS-REFERENCE TO RELATED APPLICATION

This application claims benefit to provisional patent application Ser. No. 62/348,271, filed 10 Jun. 2016, which is hereby incorporated by reference in its entirety.

BACKGROUND OF THE INVENTION

1. Field of the Invention

The present invention relates to a switch; and more particularly to a switch for providing a low water cut-off (LWCO), e.g., for a burner or other hot water/liquid heating device.

2. Brief Description of Related Art

Low water safety controls are used in the boiler industry to protect a boiler from a dry fire. These controls have single pole double throw (SPDT) contacts to operate the burner and alarm/water feeder. When the water level is normal, the circuit remains closed; and when the water level falls below the desired level, the circuit opens. When in an open state, the circuit connects to the water feeder/alarm, and when in a closed state the circuit connects to the burner. The opening and closing of the circuit depends on the mode of operation of the low water safety controls. The two modes of operation are as follows.

Automatic Mode

A low water cut-off (LWCO) circuit will open and close based on the water level. When the level of water falls below the desired level, the circuit opens and activates the water feeder which in turn restores the water in the boiler. As soon as the water level is restored, the circuit automatically closes and activates the burner. In the automatic mode, the circuit operates without any manual intervention.

Manual Mode

A. Standard Manual:

In the manual mode, the circuit will be closed when the level of the water is normal and latches open when the level of water is low. Pressing the manual reset button unlatches the mechanism and allows the circuit to open and close based on the water level. When the water level is restored, the reset button integrated with the low water safety controls needs to be pressed in order to close the circuit. This method of operation meets the requirement of ASME standard CSD-1, wherein when there is an interruption of power, if the LWCO is in a low water condition, it will remain to be in a low water condition even after power is restored.

B. High Water Manual:

High water manual mode operates opposite to the standard manual safety controls. For example, it closes the circuit when the level of water is below the high water condition and latches open in a high water condition. Pressing the manual reset button unlatches the mechanism and allows circuit to open and close based on the water level. The reset button integrated with the low water safety control has to be pressed when the water level falls below the high level water condition in order to close the circuit.

These automatic and manual models are used in two types of application in boiler industries - Steam and Hot Water applications. A boiler operates on two different input voltages: 120V and 24V. Some boilers require 120V while other requires 24V to operate. Since multiple combinations are possible, currently one needs to manufacture multiple combinations of low water cut-off switch models for use in the boiler industry. FIG. 1 shows a table having a list of varying models that need to be manufactured under the existing circumstances.

In particular, for a single voltage application, e.g., 120V or 24V, five (5) different types of low water cut-off switch models need to be manufactured as shown in the table in FIG. 1. This involves high manufacturing and inventory control cost. There is a need in the industry to reduce the number of models, to enable ease of manufacturing and to maintain optimum inventory and stock, which are all problems that currently plagues the industry right now.

SUMMARY OF THE INVENTION

In summary, the present invention provides a new and unique concept, in which a system or controller (e.g., such as a low water cutoff switch controller) may be configured or set to any one of the modes, e.g., mentioned in the table in FIG. 1, by selecting and setting a respective DIP switch. These are one time field configurable controls. Contractors can configure the LWCO switch controller to the required mode based on the operation required. Once the mode is selected, the system or controller does not allow mode setting to be changed.

Each application type or mode has its dedicated DIP switch and LED. Initially, the system or controller is not configured to any of these types or modes. On selection of any one of the DIP switches and on pressing a test/reset button, e.g. for some duration of time like 10 seconds, the controls will be configured to the selected mode. Upon selection, a respective LED will glow to indicate the selected mode. Once the system or controller is configured or set, the DIP switch functionality will be locked and any further change to the switch settings will not affect its operation.

Such a unique field configurable solution of a LWCO switch will help reduce the inventory maintained by manufacturers and distributors. Contractors/Distributors will no longer be required to order for a particular controller, and no longer be required to carry different types of controls or controller to the field based on the application (primary/secondary, automatic/manual). The present invention also allows for ease of configuration of the LWCO switch in the field itself depending on the application.

In addition, the LWCO switch may include one dual colour (Green/Yellow) LED. This LED has multiple functions, e.g., including 1. Green light—System configured to automatic mode and show LWCO power is ON.
2. Yellow light—System configured to manual mode and show LWCO power is ON.

The present invention provides a solution to the problem in the art by reducing the high manufacturing and inventory control cost, reducing the number of models, enabling ease of manufacturing and maintaining optimum inventory and stock. In effect, this new design will optimize the number of models for a single voltage application to one (1) model.

Specific Embodiments

By way of example, the present invention features a new and unique low water cutoff switch controller featuring: dual inline package (DIP) in combination with a low water cutoff switch processor.

The dual inline package (DIP) may include DIP switches. Each DIP switch may be configured to set in a respective application type or mode corresponding to a particular water heater model for the low water cutoff switch controller to control, and also be configured to provide DIP switch signaling containing information about a respective DIP switch set, e.g., by a field operator.

The low water cutoff switch processor may be configured to:

respond to the DIP switch signaling, and also configured to respond to corresponding signaling containing information about a sensed water level contained in the particular water heater model being controlled by the low water cutoff switch controller, and provide control signaling containing information to control the operation of the particular water heater model.

The low water cutoff switch controller according to the present invention is a single controller that can be used for controlling any one of a plurality of different water heater models and have different voltage applications by setting a respective one of the DIP switches.

The low water cutoff switch controller may also include one or more of the following features:

The low water cutoff switch controller may include a test/manual reset common switch configured to respond to a pressing force applied for a duration of time, and provide test/manual reset common switch signaling; and the low water cutoff switch processor configured to respond to the test/manual reset common switch signaling, and set the low water cutoff switch controller for operating in the respective application type or mode corresponding to the particular water heater model.

The low water cutoff switch processor may be configured to set the low water cutoff switch controller for operating in the respective application type or mode corresponding to the particular water heater model one time and does not allow the respective application type or mode corresponding to the particular water heater model to be changed. For example, a field operator cannot try to reuse and/or reset the DIP to a different setting at a later time and try to use it for a different particular water heater model.

The dual inline package (DIP) may include dedicated DIP switches that can be set to application types or modes, as follows:

| Sr. No. | 120 volts applications | 24 volts applications |
|---|---|---|
| 1 | Hot water - automatic mode | Hot water - automatic mode |
| 2 | Hot water - manual mode | Hot water - manual mode |
| 3 | Steam - automatic mode | Steam - automatic mode |
| 4 | Steam - manual mode | Steam - manual mode |
| 5 | Steam - high water manual mode | Steam - high water manual mode. |

The low water cutoff switch processor may also be configured to provide LED control signaling. The low water cutoff switch controller may include an LED module having LEDs corresponding to application types or modes; and the LED module may be configured to respond to the LED control signaling, and provide an LED indication of one of the application types or modes selected.

The LED module may include dual colour LEDs having a green LED for lighting to indicate an auto/power mode, a yellow LED for lighting to indicate a manual/power mode, and a red LED for lighting to indicate a control status mode.

The low water cutoff switch controller may include a relay module configured to respond to the control signaling, and provide relay signaling containing information to control the operation of the particular water heater model. By way of example, the relay signaling may include NC—burner contact signaling, no—WF contact signaling and/or com signaling, e.g., containing information to control the operation of the particular water heater model for implementing the respective relay signaling functionality, e.g., consistent with that set forth herein.

The dual inline package (DIP) may include DIP LEDs, each DIP LED corresponding to a respective one of the DIP switches for providing a respective LED indication when the respective one of the DIP switches is selected.

The low water cutoff switch processor may be configured to respond to the test/manual reset common switch signaling, and lock the low water cutoff switch controller so that any further change to the DIP switches will not effect the operation of the low water cutoff switch controller.

The plurality of different water heater models include 24V or 120V applications.

BRIEF DESCRIPTION OF THE DRAWING

The drawing includes the following Figures, not necessarily drawn to scale, including:

FIG. 2 shows a low water cutoff switch controller, according to some embodiments of the present invention.

In the Figures, similar parts are labeled with similar reference numerals. Moreover, not every part is labelled with a reference numeral and lead line in every Figure, so as to reduce clutter in the drawing.

DETAILED DESCRIPTION OF THE INVENTION

FIG. 2

Figure 1:
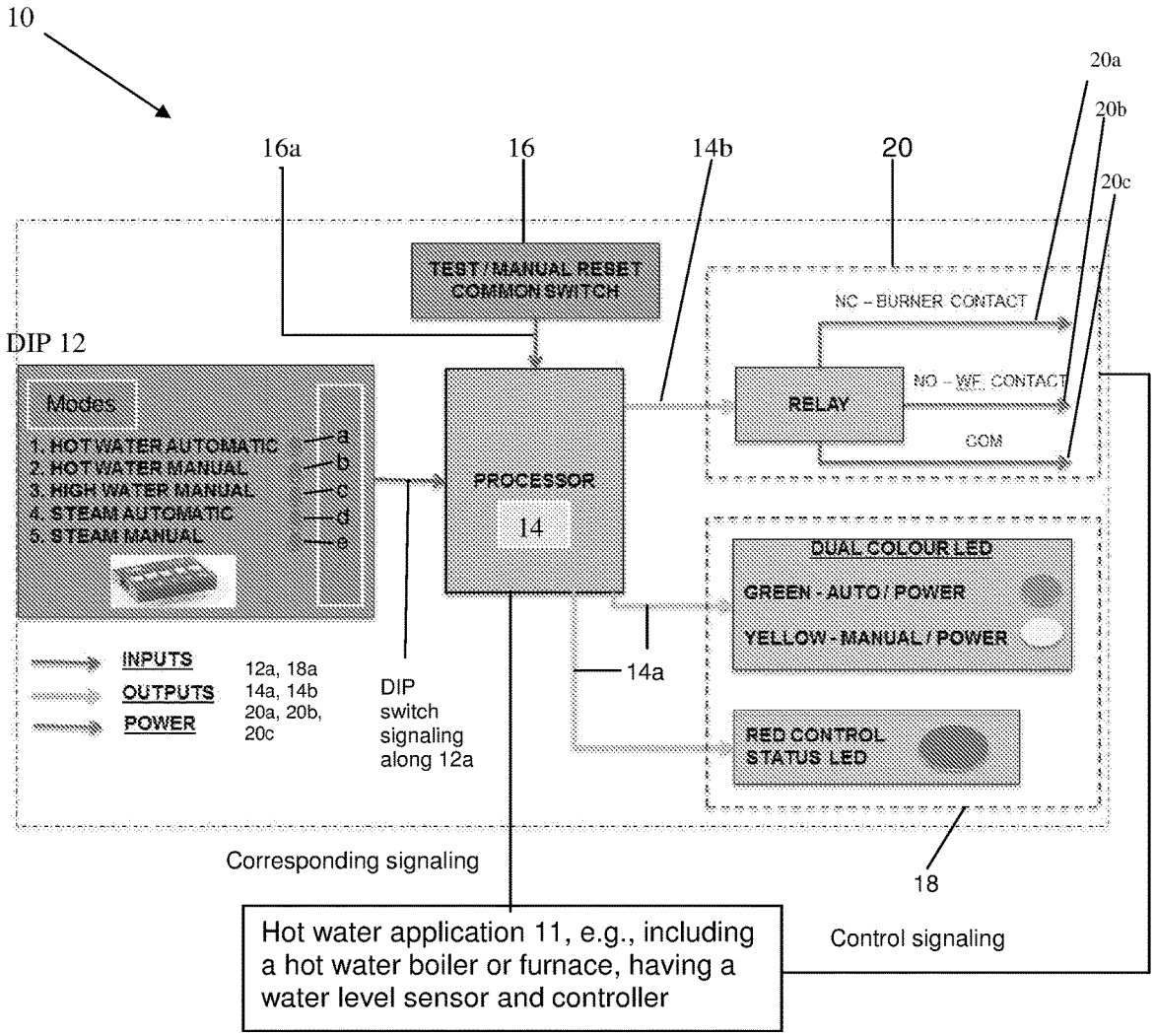
FIG. 1 is a chart of examples of 5 different types of models and two different associated voltages of switches manufactured for low water cut-off applications, e.g., that are currently known in the art.

FIG. 2 shows a new and unique low water cutoff switch controller generally indicated as 10 arranged in relation to a hot water or boiler application 11. The low water cutoff switch controller 10 includes a dual inline package (DIP) 12 in combination with a low water cutoff switch processor 14.

The dual inline package (DIP) 14 may include DIP switches labeled 1, 2, 3, 4, 5 as shown in FIG. 2. Each DIP switch 1, 2, 3, 4, 5 may be configured to set in a respective application type or mode corresponding to a particular water heater model for the low water cutoff switch controller 10 to control, and may also be configured to provide DIP switch signaling containing information about a respective DIP switch set, e.g., by a field operator.

The low water cutoff switch processor 14 may be configured to:

respond to the DIP switch signaling, and also configured to respond to corresponding signaling containing information about a sensed water level contained in the particular water heater model being controlled by the low water cutoff switch controller, and provide control signaling containing information to control the operation of the particular water heater model.

By way of example, the hot water or boiler application 11 may include a water level sensor and controller, where the water level sensor is configured to sense the water level in the hot water or boiler application 11, and provide the corresponding signal, and where the controller is configured to receive the control signaling from the low water cutoff switch controller and control the hot water or boiler application 11, e.g., consistent with that set forth herein and that known in the art. Water level sensor and controller for hot water or boiler applications like element 11 are known in the art; and the scope of the invention is not intended to be limited to the type or kind thereof, either now known or later developed in the future.

The low water cutoff switch controller 10 may include a test/manual reset common switch 16 configured to respond to a pressing force, e.g., applied for a duration of time like 10 seconds, and provide test/manual reset common switch signaling along line 16*a*. The low water cutoff switch processor 14 may be configured to respond to the test/manual reset common switch signaling along line 16*a*, and set the low water cutoff switch controller 10 for operating in the respective application type or mode corresponding to the particular water heater model. By way of example, and according to some embodiments, the low water cutoff switch processor 14 may also be configured to set the low water cutoff switch controller 10 for operating in the respective application type or mode corresponding to the particular water heater model one time and does not allow the respective application type or mode corresponding to the particular water heater model to be changed. The scope of the invention is also intended to include other types or kinds of test/manual reset procedures, e.g., to ensure that the hot water or boiler application 11 is operated safely and in compliance with any particular building codes, rules or regulations applicable to the hot water application.

By way of example, and according to some embodiments, the dual inline package (DIP) 12 may include dedicated DIP switches that can be set to application types or modes, as follows:

| Sr. No. | 120 volts applications | 24 volts applications |
|---|---|---|
| 1 | Hot water - automatic mode | Hot water - automatic mode |
| 2 | Hot water - manual mode | Hot water - manual mode |
| 3 | Steam - automatic mode | Steam - automatic mode |
| 4 | Steam - manual mode | Steam - manual mode |
| 5 | Steam - high water manual mode | Steam - high water manual mode. |

The scope of the invention is also intended to include other types or kinds of modes of operation and applications, e.g., either now known or later developed in the future.

The low water cutoff switch processor 14 may also be configured to provide LED control signaling along lines 14*a*. The low water cutoff switch controller may include an LED module 18 having LEDs, e.g., indicated by the designations "green", "yellow" and "red," corresponding to application types or modes. The LED module 18 may be configured to respond to the LED control signaling along lines 14*a*, and provide an LED indication of one of the application types or modes selected. By way of example, the LED module 18 may include dual colour LEDs having a green LED for lighting to indicate an auto/power mode, a yellow LED for lighting to indicate a manual/power mode, and a red LED for lighting to indicate a control status mode.

The low water cutoff switch controller 10 may include a relay module 20 configured to respond to the control signaling along line 14*b*, and provide relay signaling along lines 20*a*, 20*b*, 20*c* containing information to control the operation of the particular water heater model, e.g., such as the hot water application 11. By way of example, the relay signaling may include NC—burner contact signaling, no—WF contact signaling and/or com signaling, e.g., containing information to control the operation of the particular water heater model. The relay signaling along lines 20*a*, 20*b*, 20*c* may be provided as the control signaling to control the hot water application 11.

By way of example, the dual inline package (DIP) 12 may include DIP LEDs labeled a, b, c, d, e. Each DIP LED corresponds to a respective one of the DIP switches 1, 2, 3, 4, 5 for providing a respective LED indication when the respective one of the DIP switches is selected or set, e.g., by the field operator.

The low water cutoff switch processor 14 may be configured to respond to the test/manual reset common switch signaling along line 16*a*, and lock the low water cutoff switch controller 10 so that any further change to the DIP switches 1, 2, 3, 4, 5 will not effect the operation of the low water cutoff switch controller 10.

The Processor 14

By way of example, the functionality of the low cut off switch processor 14 may be implemented using hardware, software, firmware, or a combination thereof. In a typical software implementation, the processor 14 would include one or more microprocessor-based architectures having, e.g., at least one signal processor or microprocessor. A person skilled in the art would be able to program such a microcontroller (or microprocessor)-based implementation to perform the functionality described herein without undue experimentation. The scope of the invention is not intended to be limited to any particular implementation using technology either now known or later developed in the future. The scope of the invention is intended to include implementing the functionality of the processor 14*a* as standalone processor or processor module, as separate processor or processor modules, as well as some combination thereof.

By way of example, one skilled in the art would appreciate and understand how to implement the functionality of the low cut off switch processor 14 without undue experimentation, e.g., to respond to DIP switch signaling containing information about a respective DIP switch set, and also respond to corresponding signaling containing information about a sensed water level contained in the particular water heater model being controlled by the low water cutoff switch controller, and provide control signaling containing information to control the operation of the particular water heater model.

As one skilled in the art would also appreciate and understand, the low cut off switch processor 14 may also include other signal processor circuits or components, e.g. including random access memory (RAM) and/or read only memory (ROM), input/output devices and control, and data and address buses connecting the same, and/or at least one input processor and at least one output processor.

The Components in the Controller 10

The other components in the low cut off switch controller 10 are known in the art, including the DIP 12, the test/manual reset common switch 16, the LED module 18, and the relay 20. The scope of the invention is not intended to be limited to any particular type or kind of such components. Moreover, one skilled in the art would be able to implement the underlying functionality without undue experimentation, e.g., consistent with that disclosed herein.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawing herein is not drawn to scale.

Although the invention has been described and illustrated with respect to exemplary embodiments thereof, the foregoing and various other additions and omissions may be made therein and thereto without departing from the spirit and scope of the present invention.

What we claim is:

1. A field configurable low water cutoff switch controller comprising:

a dual inline package (DIP) having DIP switches that are dedicated to different application types or modes corresponding to different water heater models for the low water cutoff switch controller to control, each DIP switch configured to be set during installation in a respective application type or mode corresponding to a particular water heater model, and also configured to provide DIP switch signaling containing information about a respective DIP switch that is set in the respective application type or mode; and a low water cutoff switch processor configured to respond to the DIP switch signaling, and also configured to respond to corresponding signaling containing information about a sensed water level contained in the particular water heater model being controlled by the field configurable low water cutoff switch controller, and provide control signaling containing information to control the operation of the particular water heater model.

2. A field configurable low water cutoff switch controller according to claim 1, wherein the field configurable low water cutoff switch controller comprises a test/manual reset common switch configured to respond to a pressing force applied for a duration of time, and provide test/manual reset common switch signaling; and the low water cutoff switch processor configured to respond to the test/manual reset common switch signaling, and set the field configurable low water cutoff switch controller for operating in the respective application type or mode corresponding to the particular water heater model.

3. A field configurable low water cutoff switch controller according to claim 2, wherein the low water cutoff switch processor is configured to set the field configurable low water cutoff switch controller for operating in the respective application type or mode corresponding to the particular water heater model one time and does not allow the respective application type or mode corresponding to the particular water heater model to be changed.

4. A field configurable low water cutoff switch controller according to claim 1, wherein the DIP switches can be set to application types or modes, as follows:

| Sr. No. | 120 volts applications | 24 volts applications |
|---|---|---|
| 1 | Hot water - automatic mode | Hot water - automatic mode |
| 2 | Hot water - manual mode | Hot water - manual mode |
| 3 | Steam - automatic mode | Steam - automatic mode |
| 4 | Steam - manual mode | Steam - manual mode |
| 5 | Steam - high water manual mode | Steam - high water manual mode. |

5. A field configurable low water cutoff switch controller according to claim 2, wherein the low water cutoff switch processor is also configured to provide LED control signaling; and the field configurable low water cutoff switch controller comprises an LED module having LEDs corresponding to application types or modes, the LED module configured to respond to the LED control signaling, and provide an LED indication of one of the application types or modes selected.

6. A field configurable low water cutoff switch controller according to claim 5, wherein the LED module comprises dual colour LEDs having a green LED for lighting to indicate an auto/power mode, a yellow LED for lighting to indicate a manual/power mode, and a red LED for lighting to indicate a control status mode.

7. A field configurable low water cutoff switch controller according to claim 1, wherein the dual inline package (DIP) comprises DIP LEDs, each DIP LED corresponding to a respective one of the DIP switches for providing a respective LED indication when the respective one of the DIP switches is selected.

8. A field configurable low water cutoff switch controller according to claim 2, wherein the low water cutoff switch processor is configured to respond to the test/manual reset common switch signaling, and lock the field configurable low water cutoff switch controller so that any further change to the DIP switches will not effect the operation of the field configurable low water cutoff switch controller.

9. A field configurable low water cutoff switch controller according to claim 1, wherein the plurality of different water heater models include 24V or 120V applications.

10. A field configurable low water cutoff switch controller according to claim 1, wherein each DIP switch is configured to be manually set by a field operator during installation to a respective position corresponding to the respective application type or mode corresponding to the particular water heater model.

11. A low water cutoff switch controller comprising:

a dual inline package (DIP) having DIP switches, each DIP switch configured to set in a respective application type or mode corresponding to a particular water heater model for the low water cutoff switch controller to control, and also configured to provide DIP switch signaling containing information about a respective DIP switch set; and a low water cutoff switch processor configured to respond to the DIP switch signaling, and also configured to respond to corresponding signaling containing information about a sensed water level contained in the particular water heater model being controlled by the low water cutoff switch controller, and provide control signaling containing information to control the operation of the particular water heater model, wherein the low water cutoff switch controller comprises a relay module configured to respond to the control signaling, and provide relay signaling containing information to control the operation of the particular water heater model.

12. A low water cutoff switch controller according to claim 11, wherein the relay signaling includes NC—burner contact signaling, no—WF contact signaling and/or com signaling containing information to control the operation of the particular water heater model.

* * * * *